US005995792A

United States Patent [19]

Jo

[11] Patent Number: 5,995,792

[45] Date of Patent: Nov. 30, 1999

[54] DEVELOPING ROLL DEVICE OF AN ELECTROPHOTOGRAPHIC PROCESSOR FOR PREVENTING FRICTIONAL EROSION OF THE DEVELOPING ROLL IN SURFACE PORTIONS THEREOF

[75] Inventor: Hae-Seog Jo, Suwon, Rep. of Korea

[73] Assignee: SamSung Electronics Co., Ltd., Kyungki-do, Rep. of Korea

[21] Appl. No.: 09/008,541

[22] Filed: Jan. 16, 1998

Related U.S. Application Data

[63] Continuation-in-part of application No. 08/693,591, Aug. 5, 1996, abandoned.

[30] Foreign Application Priority Data

Aug. 4, 1993 [KR] Rep. of Korea ..... 95-24144

[51] Int. Cl.[6] ..... G03G 21/00; G03G 15/08

[52] U.S. Cl. ..... 399/286; 399/279; 492/27; 492/18; 492/53

[58] Field of Search ..... 399/286, 284, 399/285, 279; 492/27, 49, 57, 53, 18; 428/36.8

[56] References Cited

U.S. PATENT DOCUMENTS 5,283,619 2/1994 Nomura et al. .

5,305,062 4/1994 Sato et al. .

5,570,169 10/1996 Hart ..... 399/259

5,600,418 2/1997 Hart et al. ..... 399/285

*Primary Examiner*—Richard Moses

*Attorney, Agent, or Firm*—Robert E. Bushnell, Esq.

[57] ABSTRACT

A developing roller for use in an image forming apparatus using an electrophotographic process. The image forming apparatus includes a photosensitive drum having a transcribing roller cleaning device; the developing roller disposed between a transcribing device and an exposing device adjacent to the photosensitive drum, for frictionally charging toner at a place where the developing roller contacts with a supply roller and transferring the charged toner to a developing region so as to attach the charged toner to a latent image formed on the photosensitive drum; a regulating blade disposed between the developing region and the supply roller, for regulating a toner layer on the developing layer into a thin toner layer, being in contact with the developing roller; the supply roller in contact with the developing roller, for frictionally charging the toner transferred into a contact nip by a relative motion therebetween; and an agitator for transferring the toner in a toner cartridge to the supply roller. The developing roller includes a body corresponding to a image region; end parts corresponding to a non-image region; a shaft for transferring a driving force and maintaining strength of the developing roller; and a joint where the body and the end parts are joined.

25 Claims, 8 Drawing Sheets

DEVELOPING ROLL DEVICE OF AN ELECTROPHOTOGRAPHIC PROCESSOR FOR PREVENTING FRICTIONAL EROSION OF THE DEVELOPING ROLL IN SURFACE PORTIONS THEREOF

CLAIM OF PRIORITY

This application is a continuation-in-part of Ser. No. 08/693,591 filed Aug. 5, 1996 abandoned. This application also makes reference to, incorporates the same herein, and claims all benefits accruing under 35 U.S.C §119 from an application entitled Developing Roll Device Of An Electrophotographic Processor earlier filed in the Korean Industrial Property Office on Aug. 4, 1995, and there duly assigned Ser. No. 24144/1995 by that Office.

BACKGROUND OF THE INVENTION

1. Field of the Invention

The present invention relates to an image forming apparatus using an electrophotographic process, such as a laser beam printer, an LED printer, a facsimile, and a digital copying machine, and in particular, to a developing roller for an image forming apparatus employing a developing technique for forming a toner image using negative toner and a non-magnetic single component developing technique using a non-magnetic single component toner for developer.

2. Description of the Related Art

As illustrated in FIG. 1, an image forming apparatus using an electrophotographic process translates a digital image signal received from a computer or a scanner onto a recording sheet in the form of a visible image. The image forming apparatus includes a developing unit for forming a latent image according to the received digital image signal and attaching toner onto the latent image to form a toner image. Then, the toner image is fixed on the recording sheet, so that the original digital image signal may be printed out on the recording sheet in the form of a fixed image.

Referring to FIG. 1, the image forming apparatus uniformly electrically charges a surface of a photosensitive drum 1 by corona discharging of a charging roller 7. The digital signal received from the computer or scanner is converted into an optical signal by a laser scanning unit or an LED array 9. The optical signal forms an electrostatic latent image on the photosensitive drum 1. Toner 6 contained in a toner cartridge 8 is transferred toward a supply roller 3 by rotation of an agitator 4, and charged with a negative electric charge by the supply roller 3. Then, as a developing unit 2 rotates, the toner is transferred to a developing nip composed of the photosensitive drum 1 and the developing roller 2. A toner regulating blade 5 mounted on an upper part of the developing roller 2 forms a uniform toner layer on the surface of the developing roller 2. Thereafter, as the photosensitive drum 1 rotates, toner particles 6*a* charged with the negative electric charge are transferred onto the latent image, passing through a contact between the photosensitive drum 1 and the developing roller 2, thereby forming the visible toner image on the surface of the photosensitive drum 1.

Further, recording sheets 12 stacked in a sheet feeding cartridge 13 are picked up sheet by sheet by a sheet feeding roller 11 and transferred to registration rollers 14 and 14' placed at a front end of an aligning unit. Then, the recording sheet 12 is transferred to a transcribing nip which is a rotatable contact part between the photosensitive drum 1 and a transcribing roller (or a corona device) 10, in synchronism with a scanning unit 9. As the recording sheet 12 enters the transcribing nip, the toner image formed on the photosensitive drum 1 is transcribed onto the recording sheet 12 by an electrostatic force according to an air breakdown phenomenon by a high voltage applied to the transcribing roller 10, the high voltage having an opposite polarity to that of the toner. The recording sheet 12 on which the toner image is transcribed is transferred to a fixing unit by a transfer guide 15*a*, and the toner is fixed on the recording sheet 12 by the heat and pressure caused by a heat roller 16 and a pressure roller 17 in the fixing unit.

The image fixed on the recording sheet 12 is discharged to an exterior of the apparatus passing through lower sheet discharging rollers 19 and 19*a*, and upper sheet discharging rollers 18 and 18*a*, being guided by guide members 15*b* and 15*c* of a sheet discharging unit.

FIGS. 2A and 2B show a plane view and a side view of the image forming apparatus for use in an image printing device, respectively. In the conventional image forming apparatus shown in FIGS. 2A and 2B, the toner leaking out through transfer paths A and B may contaminate the photosensitive drum 1 in the shape of a belt, and the toner having passed the regulating blade 5 at an interval D where the toner, which has failed to undergo friction charging by a side wall of the developing roller 2 or the supply roller 3 and thus does not enough negative electric charge, may be transferred to the photosensitive drum 1. The non-image region keeps the negative potential. The contamination belt of toner may cause the contamination on both sides of the recording sheet 12.

Now, reference will be made to FIG. 3 to describe the paths A and B which are the origin of the above stated contaminations. As illustrated, toner 6, frictionally charged at a nip E formed between developing roller 2 and supply roller 3, is attached to developing roller 2 and transferred toward a lower part of regulating blade 5, as developing roller 2 rotates. Regulating blade 5 regulates toner 6 attached onto the surface of developing roller 2, so that a limited amount of the toner only may be transferred to the surface of developing roller 2 upon passing through regulating blade 5. Regulating blade 5 blocks transfer of the toner attached onto developing roller 2, so that a considerable pressure is caused at a space between the supply roller 3 and regulating blade 5 on developing roller 2. In order to prevent the contamination of recording sheet 12 and the interior of the apparatus due to the pressure, the conventional image forming apparatus shown in FIGS. 2A and 2B includes a circular seal (or rubber foam) 20*a* for preventing leakage of the toner among developing roller 2, regulating blade 5, and toner cartridge 8. In order to prevent leakage of the toner having passed through circular seal 20*a*, a side-wall seal 20*b* blocks leakage of the toner through side walls of developing roller 2 and regulating blade 5. Alternatively, any one of circular seal 20*a* and side-wall seal 20*b* is selectively used to prevent leakage of the toner.

FIG. 4 illustrates a principal part of an image forming apparatus disclosed in Japanese patent publication No.07-253715, filed by Tanaka, in which a low-friction material is coated over a contact part between a developing roller 22 and a regulating blade 23 disposed at an upper part of developing roller 22. Further, side-wall seals 24, comprising seal portions 24*a* and 24*b*, are mounted at both sides of developing roller 22 by using double-faced adhesive tape 24*d*. In order to prevent leakage of the toner through the path B, a seal piece 24*c* is mounted at both contacts of regulating blade 23 and side-wall seal portions 24*a* and 24*b* are mounted at both side walls of developing roller 22. It is noted that this prior art device does not include the circular seal 20*a* (FIGS. 2A and 2B) mounted at the supply roller.

By coating the contact part between developing roller 22 and regulating blade 23 by using the low-friction material, the prior art device described above may successfully regulate the toner layer, when developing roller 22 has no toner attached thereto (i.e., an initial condition before the toner is supplied), or when toner remains after use of the apparatus. Further, the device has side-wall seals 24 mounted on the side walls of the developing roller 22, so as to prevent leakage of the toner. However, from the viewpoint of sealing, if the supply roller does not have circular seal 20*a*, the toner in the developing unit has more opportunities to pass through the side wall, so that more toner may penetrate into a space between side-wall seal portion 24*b* and developing roller 22. As developing roller 22 rotates, the toner having penetrated between side-wall seal portion 24*b* and developing roller 22 is transferred to the photosensitive drum, causing the contamination belt of toner thereon. As a result, the recording sheet may be contaminated at both sides thereof.

Further, if an over-pressure is applied to the side walls in order to solve this problem, the side walls of developing roller 22 will be worn away so that the worn developing roller 22 may no longer maintain the toner sealing function. Accordingly, as shown in FIG. 5, the device may have an worn area 25 through which the toner leaks out.

FIG. 6 illustrates an image forming apparatus disclosed in U.S. Pat. No. 4,641,602, filed by Kasai, in which a high voltage having a polarity opposite to that of the toner is applied to a non-image region b of a developing roller 25, so that a regulating roller 26 may attract the unnecessary toner to prevent the unnecessary toner from being transferred to the photosensitive drum. However, the device proposed by Kasai has the following shortcomings in putting it to practical use.

First, U.S. Pat. No. 4,641,602 assumes that the toner is charged with only one of the negative and positive electric charges. Actually, however, the existing commercialized toner has a friction charge distribution feature as shown in FIG. 7. The toner maker makes a deep study to produce the toner which has a narrow charge distribution width and prevents generation of wrong signed toner particles having an insufficient charge A in case of necessity of the negative charge. Therefore, when using the commercialized toner having the charge distribution feature of FIG. 7, if the toner is charged with the negative charge, it may be impossible to electrically control the toner particles at an area A as expected.

That is, referring again to FIG. 6, in a developing technique using negative toner, in order to prevent the toner from being attached to the non-image region thereby to prevent leakage of toner, a negative voltage is applied to a non-image sleeve 25*c* of the developing roller 25 and a positive voltage is applied to a sleeve 26*c* of the regulating roller 26. The conventional device is effective for the toner at the areas other than the area A. However, the leakage of the toner may be increased undesirably at the area A. That is, the insufficiently charged toner, which is neutral or reversed, transfers excessively to the photosensitive drum, thereby causing the contaminations of the photosensitive drum and the recording sheet.

Second, the prior art apparatus can not prevent the toner from leaking through an interval "c" and the side walls of developing roller 25. This leakage becomes more serious when developing roller 25 pressingly contacts regulating roller 26 with a specified nip.

Third, insulating layers 25*b* and 26*b* at a boundary between an image region "a" and a non-image region "b" of the developing roller 25 and the regulating roller 26 cannot freely control the movement of the toner. Since the toner particles have a diameter of 3–15 $\mu$m, the uncontrollable toner may leak out at this boundary little by little, thereby contaminating the photosensitive drum.

FIG. 8 illustrates an image forming apparatus disclosed in Japanese patent publication No. 04-085571, filed by Fukumoto, in which a PTFE (polytetrafluoroethylene resin) layer 29*b* is attached to a chloroprene rubber (or silicon rubber) 29*a* with hot melt or double-sided tapes 29*c* and 29*d*, in order to stably seal a developing roller 30, by using elasticity of the chloroprene or silicon rubber and a low-friction feature of the PTFE layer. However, the prior art apparatus is effective only for two-component or 1.5-component developing technique in which the toner is charged and transferred by a carrier which is much larger than the toner particle in size, and is placed on developing roller 30.

In the case of single component non-magnetic toner, the carrier (commonly having a diameter of over 3 $\mu$m) is not used and the toner has a diameter of 3–15 $\mu$m. Thus, it is impossible to prevent penetration of the toner between the PTFE sealing material and the developing roller. Particularly, in case of the old-fashioned polymer toner, it is more difficult to prevent leakage of the toner by the PTFE sealing material.

Furthermore, in the image forming apparatus proposed by Fukumoto, the toner penetrating between PTFE 29*b* and developing roller 30 is easily charged with a positive electric charge. That is, the principal ingredients of the toner is styrene and, in accordance with triboelectric charge service, the PTFE charges the toner with the positive electric charge more easily than nylon, polyurethane, SEP (Silicon Ethylene Propylene) rubber, and NBR (Nitril Butadiene Rubber) do. When using a known developing technique (e.g., a commercialized LBP or LED printer), unwanted reversely-charged toner (in this case, the toner charged with zero or "+" electric charge) exists on developing roller 30. In this case, since the toner has the polarity opposite to that of the non-image region of photosensitive drum 31, the toner may be readily transferred to photosensitive drum 31, thereby contaminating the photosensitive drum. Furthermore, in case of increasing pressure of the seal in order to prevent penetration of toner, both end parts of developing roller 30 which rub against PTFE 29*b* may be worn out.

As illustrated in FIG. 9, Japanese patent publication No. 03-102369, filed by Umezawa, discloses another image forming apparatus, in which a belt-shaped sealing material 33 is inserted between a photosensitive drum 31 and a developing roller 32 of which both ends are tapered. This prior art apparatus may effectively seal the space between the photosensitive drum 31 and the developing roller 32, but it needs a separate sealing plan in order to prevent undesired leakage of the toner from a developing chamber composed of the developing roller 32, a supply roller 34, and a regulating blade 35.

SUMMARY OF THE INVENTION

It is therefore an object of the present invention to provide a developing roller, in which a circular seal and a side-wall seal are mounted on the developing roller to prepare a double blocking wall on the developing roller, thereby to prevent toner from being leaked out from a developing chamber.

It is another object of the present invention to provide a developing roller capable of charging toner penetrated between a seal and a developing roller with an electric charge of a desired polarity.

It is still another object of the present invention to provide a developing roller which is free from abrasion against a sealing material, by using a material with a high tolerance for abrasion for a circular seal and a side-wall seal of the developing roller.

It is further still another object of the present invention to provide a developing roller capable of preventing leakage of toner to a photosensitive drum so as to prevent contamination of an image.

It is yet another object of the present invention to provide a developing roller suitable for a commercial mass-production.

To achieve the above and other objects and features of the present invention, there is provided a developing roller for use in an image forming apparatus using an electrophotographic process. The image forming apparatus includes a photosensitive drum having a transcribing roller cleaning device; the developing roller disposed between a transcribing device and an exposing device adjacent to the photosensitive drum, for frictionally charging toner at a place where the developing roller contacts with a supply roller and transferring the charged toner to a developing region so as to attach the charged toner to a latent image formed on the photosensitive drum; a regulating blade disposed between the developing region and the supply roller, for regulating a toner layer on the developing layer into a thin toner layer, being in contact with the developing roller; the supply roller in contact with the developing roller, for frictionally charging the toner transferred into a contact nip by a relative motion therebetween; and an agitator for transferring the toner in a toner cartridge to the supply roller. The developing roller includes a body corresponding to a image region; end parts corresponding to a non-image region; a shaft for transferring a driving force and maintaining strength of the developing roller; and a joint for joining the body with the end parts.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

In the following description, numeral specific details such as detailed structures of the developing roller and materials used therefor, are set forth to provide a more thorough understanding of the present invention. It will be apparent, however, to one skilled in the art that the present invention may be practiced without these specific details. The detailed description of known function and constructions unnecessarily obscuring the subject matter of the present invention will be avoided in the present invention. It is assumed in the application that toner is charged with a negative electric to charge and a latent image on a photosensitive drum is charged with a positive electric charge, and a non-image region of the photosensitive drum has a negative potential.

Figure 10:
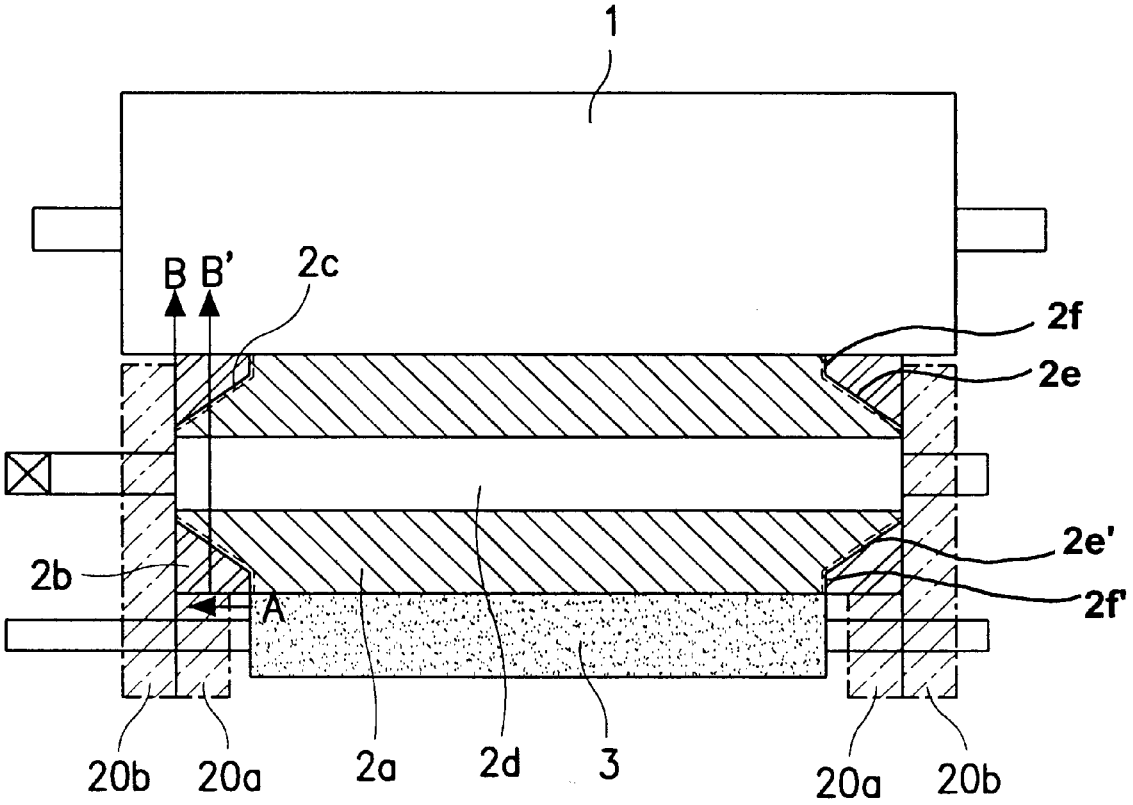
FIG. 10 is a diagram showing a developing roller in an image forming apparatus according to a preferred embodiment of the present invention.
Figure 11:
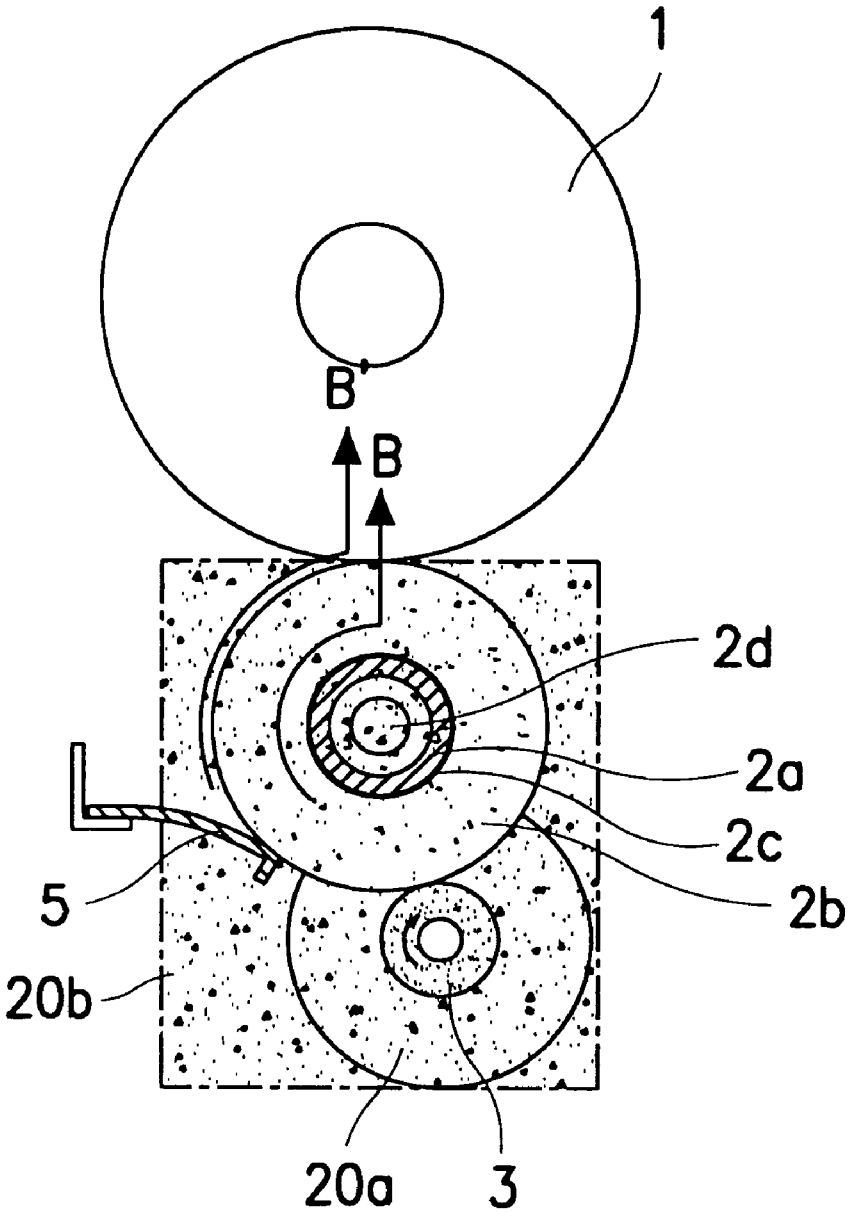
FIG. 11 is a side view of the developing roller according to a preferred embodiment of the present invention.

As illustrated in FIGS. 10 and 11, an image forming apparatus according to the present invention includes a developing roller 2, a regulating blade 5 and a supply roller 3. Developing roller 2 is placed between a photosensitive drum 1 and a transcribing/exposing unit (not shown) adjacent to photosensitive drum 1 having a cleaning or cleaning auxiliary means. Further, developing roller 2 frictionally charges the toner at a contact area with supply roller 3 and transfers the charged toner to a developing region so as to attach charged toner to a latent image on photosensitive drum 1, thereby forming a toner image. Regulating blade 5 is placed between the developing region and supply roller 3 in contact with developing roller 2, to uniformly regulate the toner layer on developing roller 3. Supply roller 3 frictionally charges the toner inserted into a nip between supply roller 3 and developing roller 2. A transfer device (not shown) transfers toner in a toner cartridge to supply roller 3.

As illustrated, developing roller 2 includes a body 2*a* corresponding to an image region, both end parts 2*b* corresponding to a non-image region, a shaft 2*d* for transferring a driving force and maintaining strength of developing roller 2, wherein body 2*a* has tapered, i.e., beveled, ends 2*e* and shoulders 2*f* forming a joint 2*c* for firmly and inseparably joining body 2*a* with end parts 2*b*. As shown, end parts 2*b* have a molded surface portion, i.e., a cone shaped bore 2*e*' and a flat surface area 2*f*', which tightly fits to joint 2*c*.

If the toner sealing pressure in the developing chamber is excessive, developing roller 2 will be worn out. On the contrary, if the toner sealing pressure is insufficient, a single component non-magnetic toner having a particle size of 3–15 $\mu$m may easily penetrate into a space between a seal and developing roller 2. Thus, in order to reduce an amount of the toner penetrating between developing roller 2 and the seal as represented by arrow A of FIG. 10 in spite of the high pressure therebetween, a circular seal 20*a* is mounted at both ends of supply roller 3. A side-wall seal 20*b* is mounted at both side walls of developingroller 2 and supply roller 3, to seal the toner having penetrated circular seal 20*a*. However, the toner that may have penetrated circular seal 20*a* may be transferred to photosensitive drum 1 along a path B of FIG. 11. Thus, in order to prevent this, the present invention charges the penetrated toner with a negative electric charge so that the negatively charged toner may transfer along the path B' through regulating blade 5, so as to prevent photosensitive drum 1 from attracting the negatively charged toner. Here, the non-image region of photosensitive drum 1 is charged with the negative electric charge, and regulating blade 5 has a same width as that of developing roller 2.

In order to charge the toner that may have penetrated between developing roller 2 and seal members 20*a* and 20*b*, and to maintain a relatively higher sealing pressure, material such as conductive SEP (Silicon Ethylene Propylene) rubber, conductive polyurethane, or conductive NBR (Nitril Butadiene Rubber) are used. Further, since the SEP rubber and polyurethane have different tolerances for friction according to their hardness, it is preferable to use a material having an ASKER A hardness of over 45°.

Accordingly, toner that may have penetrated into side-wall seal 20*b* of developing roller 2 is charged with a negative electric charge, thereby preventing even a small amount of penetrated toner from being attracted to the non-image region of the negatively charged photosensitive drum through path B.

The body 2*a* of developing roller 2 is composed of the NBR, polyurethane or silicon, of which conductivity is determined according to an environmental condition of the toner. Conductive body 2*a* is firmly attached to conductive end parts 2*b* of developing roller 2 at joint 2*c* so that a bias (not shown) of the developing roller provided via shaft 2*d* is smoothly supplied up to end parts 2*b*. In this manner, it is possible to control the toner charged with the negative electric charge by an electric field generated on the surface.

Figure 12:
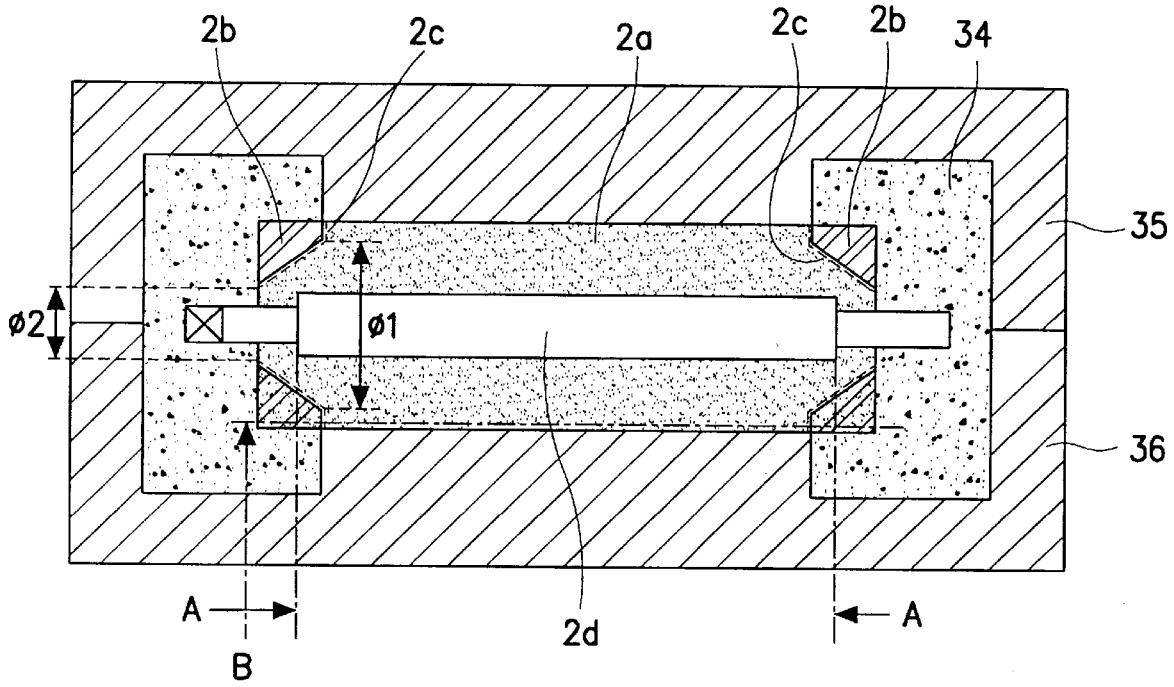
FIG. 12 is a schematic diagram showing a mold for manufacturing the developing roller according to a preferred embodiment of the present invention.

FIG. 12 illustrates a molding press for the commercial mass-production of developing roller 2. End parts 2*b* are cylindrical and have tapered, ie., cone shaped, inner surfaces and are first formed by a molding or extruding process, and inserted into collars 34 of the molding press for the developing roller 2 having the shape shown in FIG. 12. Then, shaft 2*d* and collar 34 are mounted on a lower hard core 36. Thereafter, when press molding, a material for roller body 2*a* is poured thereinto and an upper hard core 35 covers these materials. Pressure and heat are then applied thereto to form developing roller 2. Alternatively, injection molding may be used in which the material for body 2*a* is injected into a hollow after attaching upper core 35 to lower hard core 36.

However, the product may become inferior during the molding process for developing roller 2, since the molding pressure causes the body material to penetrate between the end parts 2*b* and the collar 34. In order to solve this problem, as shown in FIG. 12, inner diameters of the mold should be $\phi 1 > \phi 2$, as shown, according to the principles of the present invention.

Figure 13:
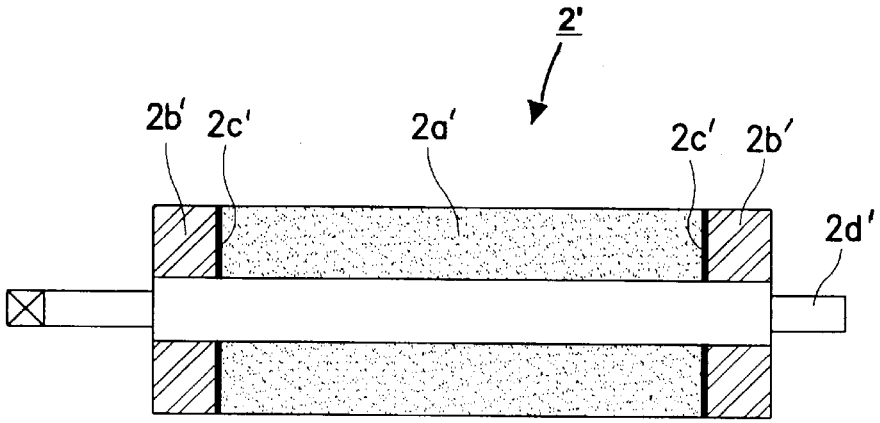
FIG. 13 is a diagram showing a structure of the developing roller according to another embodiment of the present invention.

The developing roller molded in the above described manner undergoes the curing, cutting and polishing processes in order to produce the final product. In FIG. 12, a line indicated by an arrow A represents an cutting surface and a line indicated by an arrow B represents a grinding surface. That is, the material is placed in the mold and goes through a first and then second curing process, and when the product (developing roller) is then removed from the mold it is larger than desired. The developing roller is further refined by cutting at a desired width and then the diameter is ground down followed by a polishing, or finishing, of the surface of the developing roller FIG. 13 illustrates another developing roller according to second embodiment of the present invention. As illustrated, a developing roller 2' includes shaft 2*d* for transferring the driving force and maintaining strength of developing roller 2', a body 2*a'* corresponding to the image region of photosensitive drum 1, and joint part 2*c'* for jointing body 2*a'* with the end parts 2*b'* corresponding to the non-image region of photosensitive drum 1. This developing roller is featured in that all of end parts 2*b'* are made of the different material from that of body 2*a'*. Other material features are the same as described above. Further, a circular seal is installed at both ends of the supply roller to prevent the toner from leaking out to the non-image region, and a side-wall seal is installed at the side walls of the supply roller and the developing roller.

When developing roller 2' having the above stated structure is applied to developing technique using positive toner, end parts 2*b'* are made of conductive PTFE into which the conductive material such as carbon is injected, so that the toner that may have penetrated into the area of the seals may be charged with a positive electric charge when the penetrated toner rubs against developing roller 2'. Here, having a high abrasion tolerance, the PTFE may provide a sufficient sealing pressure.

Figure 1:
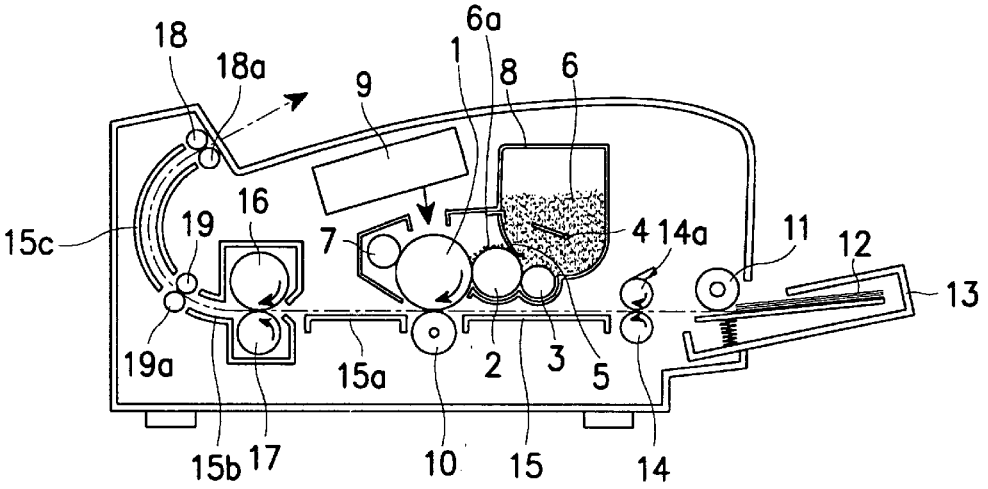
FIG. 1 is a schematic diagram showing a common image forming apparatus according to the state of the art.
Figure 2A:
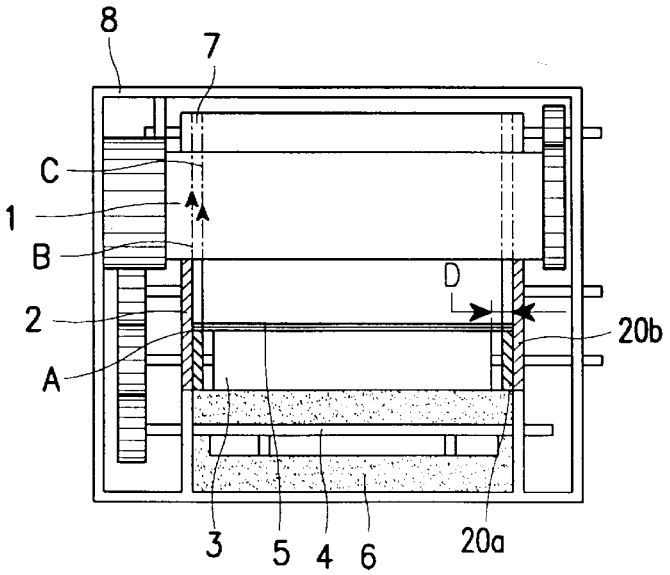
(PRIOR ART) FIG. 2A
FIGS. 2A and 2B are a plane view and a side view of a developing roller according to the prior art, respectively.
Figure 2B:
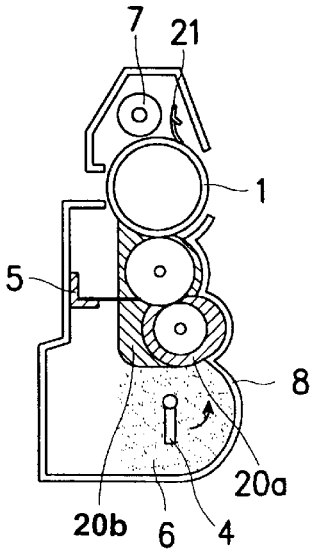
(PRIOR ART) FIG. 2B
Figure 3:
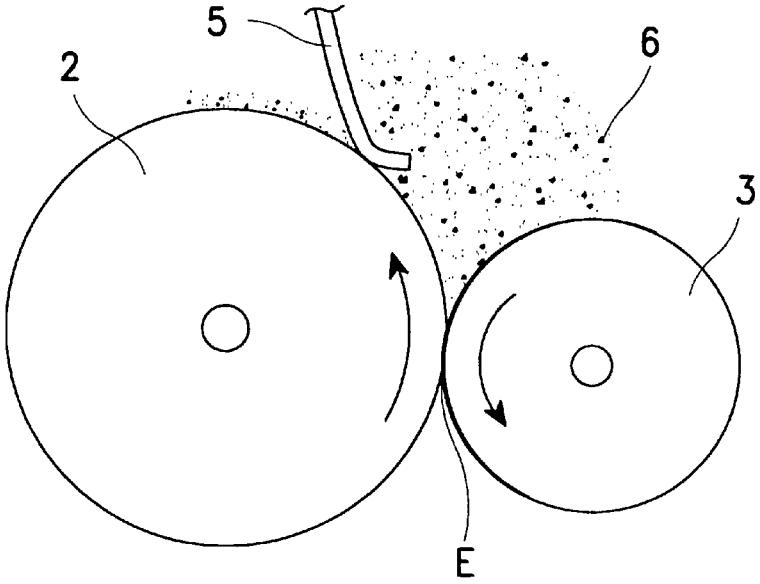
FIG. 3 (PRIOR ART)
FIG. 3 is a diagram showing operation of a developing roller and a supply roller according to the prior art.
Figure 4:
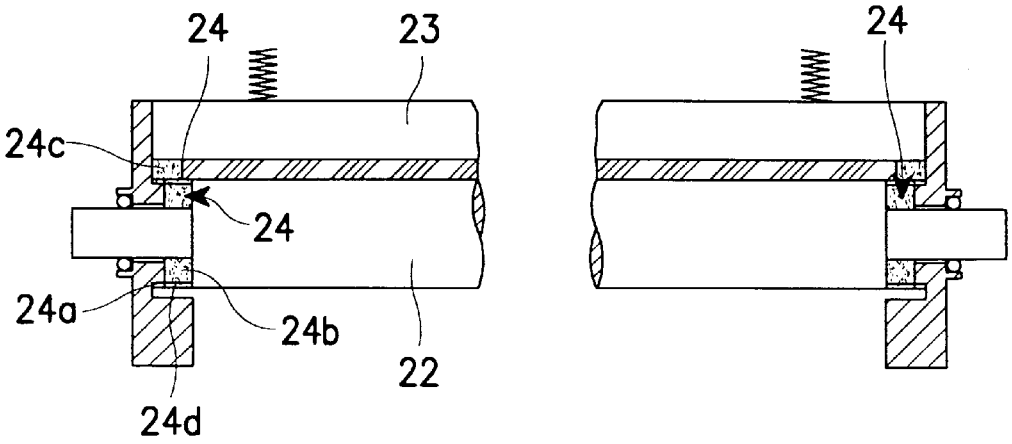
FIG. 4 (PRIOR ART)
FIG. 4 is a diagram showing a regulating blade mounted on a developing roller according to the prior art.
Figure 5:
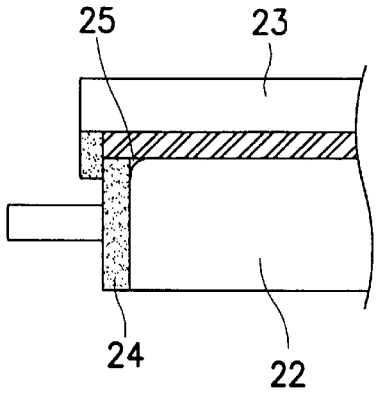
FIG. 5 (PRIOR ART)
FIG. 5 is a diagram showing a crack formed at a developing roller, through which toner may leak out, according to the prior art.
Figure 6:
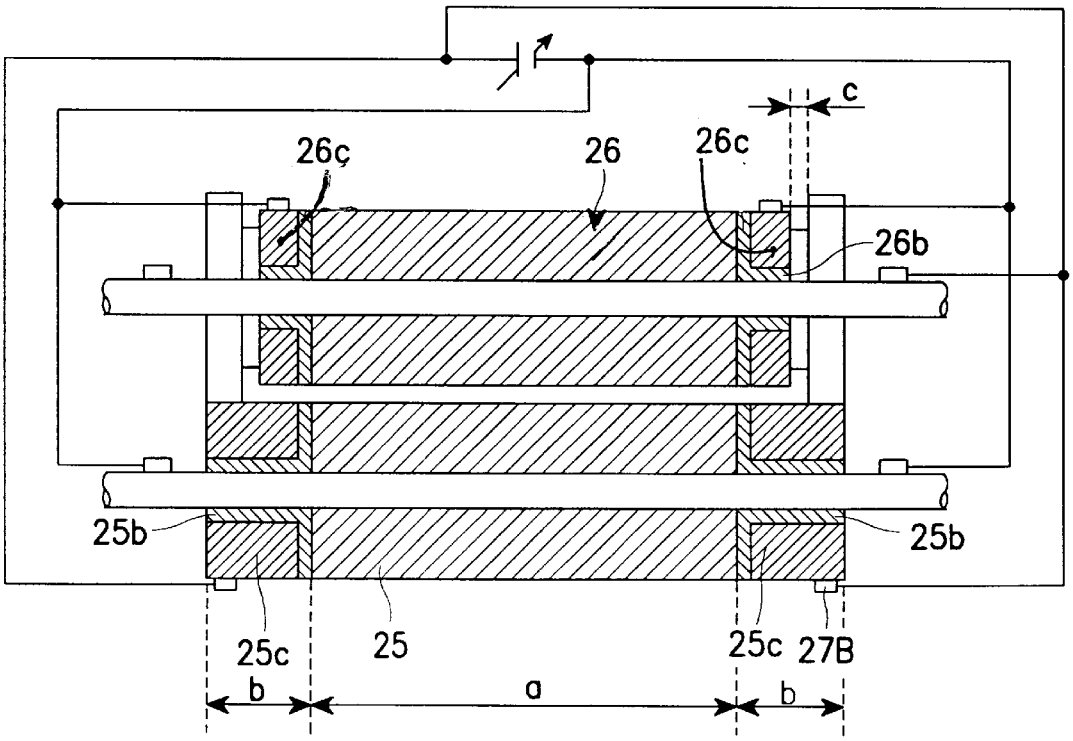
(PRIOR ART) FIG. 6
FIG. 6 is a diagram showing a combination structure of a developing roller and a supply roller according to the prior art.
Figure 7:
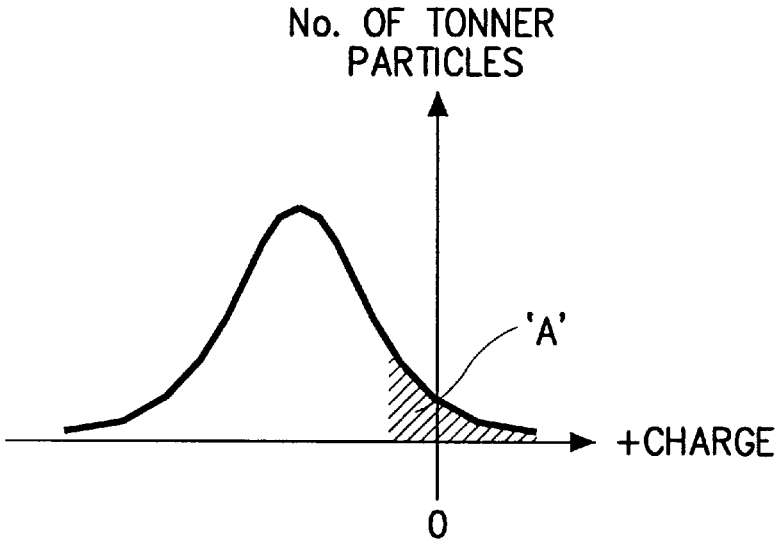
FIG. 7 (PRIOR ART)
FIG. 7 is a diagram showing a typical charge distribution curve of toner.
Figure 8:
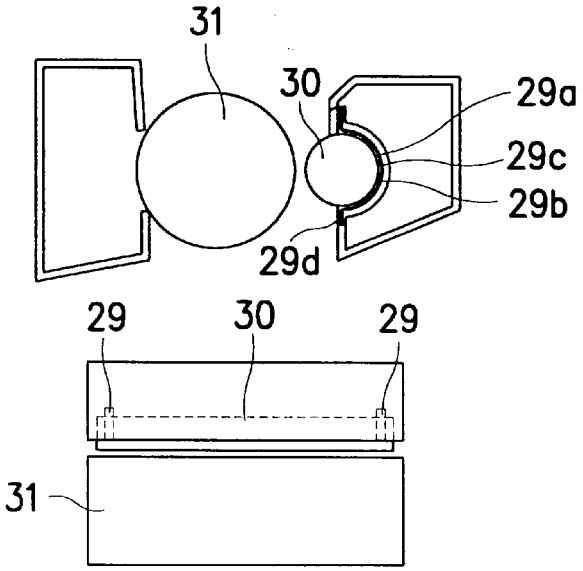
(PRIOR ART) FIG. 8
FIG. 8 is a diagram showing a combination structure of a photosensitive drum and a developing roller according to the prior art.
Figure 9:
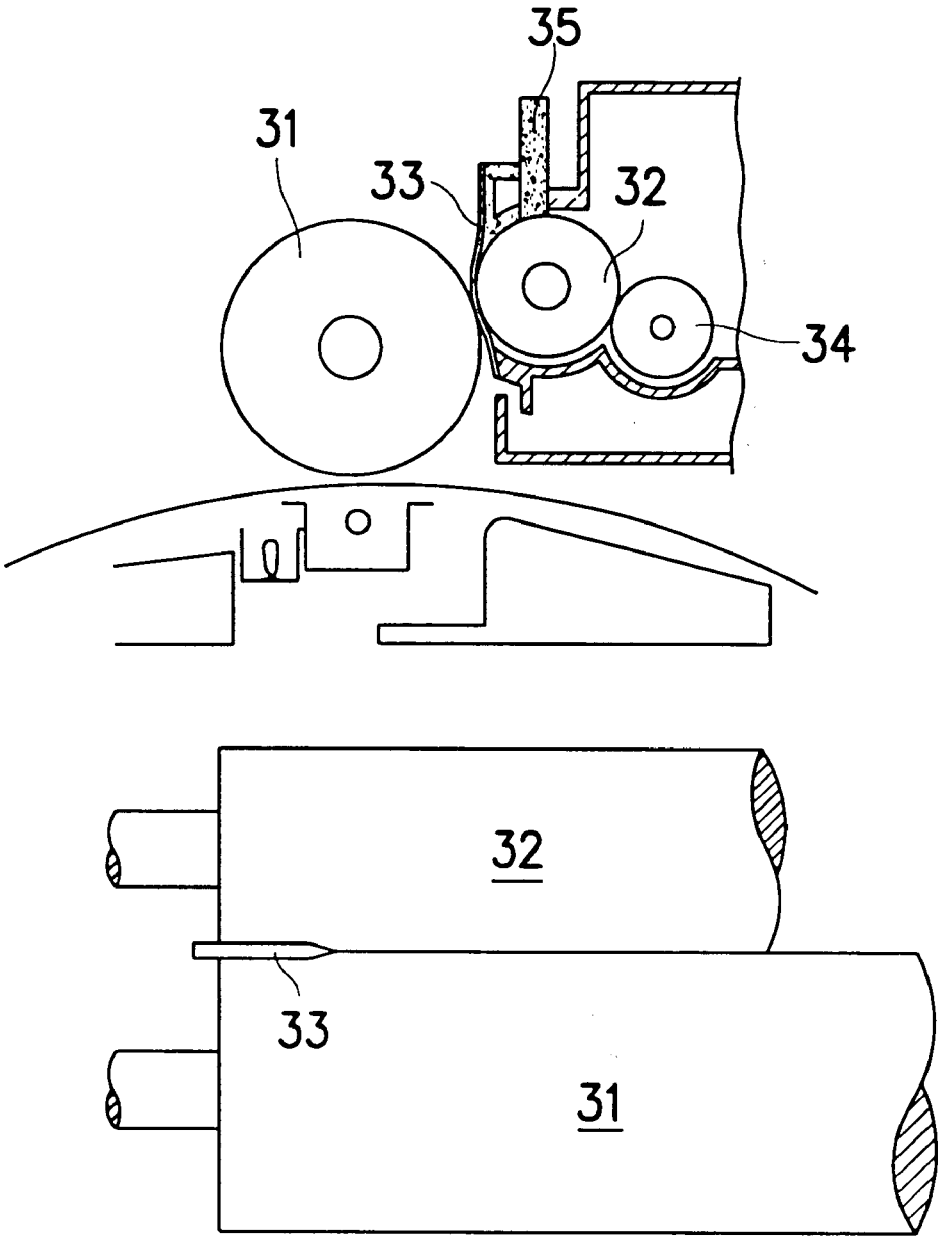
(PRIOR ART) FIG. 9
FIG. 9 is a diagram showing a combination structure of a developing roller and a supply roller according the prior art.

The toner in the developing chamber is frictionally charged at the nip formed by the developing roller and supply roller, and a thick layer of charged toner is attached onto the developing roller and transferred to the regulating blade, as the developing roller rotates. However, as shown in FIG. 3, the thick toner layer is regulated into a thin toner layer, while passing through the regulating blade, and the regulated toner layer is transferred to the developing nip formed by the developing roller and the photosensitive drum according to the rotation of the developing roller, thereby forming the toner image on the photosensitive drum.

Here, regulating blade 5 regulates the toner layer according to a combination of the complicated parameters, such as pressure and surface roughness. The toner returned back to the developing chamber has a violent movement, thereby increasing the pressure within the developing chamber. Then, the toner will gain a force for moving out from the developing chamber due to the increased pressure of the developing chamber, mainly through path A of FIG. 10. In accordance with the present invention, circular seal 20*a* made of polyurethane foam as a first sealing wall is installed in order to block path A. However, since the toner is powder having a good fluidity, it is impossible to completely seal toner having a diameter of 3–15 $\mu$m, at a sealing pressure to such an extent that end parts 2*b* of the elastic developing roller should not be worn out.

When end parts 2*b* of developing roller 2 are made of SEP rubber having an ASKER A hardness of over 45° and maximum pressure is applied by using close cell-type polyurethane as long as the SEP rubber is not worn out, the old-fashioned single component non-magnetic polymer toner having particles with a diameter of 8 $\mu$m is transferred to the developing roller at a thickness of 0.01–0.05 m/cm$^2$ at both end parts. In accordance with some experiments, the conductive polyurethane and the conductive polytetrafluoroethylene also have the similar sealing features.

Therefore, it is necessary to prevent leakage of even a small amount of the toner which has penetrated between the circular seal and the developing roller, and in the present invention, side-wall seal 20*b* plays this role. Further, it is necessary to prevent the toner that may have penetrated between circular seal 20*a* and developing roller 2 from being leaked out to side wall seal 20*b*, and to prevent transfer of the toner to photosensitive drum 1 along paths B' and B, by charging the toner with the same polarity of the electric charge as that of the image region.

In the preferred embodiment, end parts 2*b* of developing roller 2 are made of conductive SEP rubber, the conductive polyurethane and the conductive NBR, and maximum pressure is applied by using a circular seal 20*a* made of polyurethane foam. When the developing technique which charges the old-fashioned single component non-magnetic polymer toner whose particles have a diameter of 8 $\mu$m with a negative electric charge, although a toner layer of 0.01–0.05 g/cm$^2$ is transferred to the developing region, the toner layer is electrically repulsed from the photosensitive drum's non-image region having a negative electric charge, so that the photosensitive drum may be kept clean.

When the same experiment was made by using PTFE, although the amount of toner leakage was similar, the non-image region of the photosensitive drum was contaminated, and the degree of contamination increased as the printing increased in number.

That is, when the end parts of the developing roller were formed with the PTFE, it was noted that the electrical repulsive force with respect to photosensitive drum 1 was insufficient. Thus, transfer of toner toward the photosensitive drum could not be prevented sufficiently. The reason can be construed that when toner having styrene as a main ingredient rubs against the PTFE which is more highly charged with a negative electric charge than the other material such as SEP rubber, polyurethane, and NBR, the toner is charged with a positive electric charge and the end parts of the developing roller are charged with a negative electric charge. Therefore, the PTFE may be used for the seal material for the end parts of the developing roller, when the developing technique uses positive toner.

The developing roller according to the present invention can electrically control the toner in the direction B' (FIG. 10) as described above, and the side-wall seal additionally prevents leakage of the small amount of toner which may have passed through the circular seal by applying the pressure to the side wall of the developing roller. Further, the developing roller charges the penetrated toner with an electric charge having the same polarity, thereby preventing the toner from being attached to the photosensitive drum and completely preventing contamination of the photosensitive drum by virtue of the circular seal and the side-wall seal.

As described in the foregoing, the present invention is directed to preventing leakage of the single component non-magnetic toner, having particles with a diameter of 3–5 $\mu$m, from the developing chamber to an unwanted place (e.g., the non-image region and the interior of the apparatus). As long as an abrasion tolerance of developing roller 2 made of an elastic substance and a permanent compressive strain of the seal member are not caused, the pressure is applied as high as possible. Here, most of the toner is mechanically blocked, and the small amount of penetrated toner is frictionally charged with the electric charge having the same polarity as that of the image region, thereby preventing the toner from being transferred to the photosensitive drum. Accordingly, the contamination of the recording sheet and the contamination within the image forming apparatus may be completely prevented.

As can be appreciated from the foregoing descriptions, when the developing technique uses negative toner, the end parts of the developing roller are made of SEP rubber, NBR and polyurethane, in which the ASKER A hardness of the above materials should be over 45°. Further, when the developing technique uses a positive toner, PTFE having a good capability of charging the toner with a positive electric charge upon rubbing is used for the sealing material installed at the end parts, so that the toner may be completely sealed electrically as well as mechanically.

While the present invention has been shown and described with reference to a certain preferred embodiment thereof, it will be understood by those skilled in the art that various changes in form and details may be made therein without departing from the spirit and scope of the present invention as defined by the appended claims.

what is claimed is:

1. A developing roller for applying toner to a photosensitive drum in an image forming apparatus, said developing roller comprising:

a body having a first portion a second portion and a third portion formed centrally between said first and second portions, said third portion forming a cylindrical surface area corresponding to an image forming region of said photosensitive drum;

end parts corresponding to a non-image region of said photosensitive drum;

said first and second portions of said body forming tapered joints for joining said body with said end parts; and a shaft for transferring a driving force and maintaining strength of the developing roller, said shaft extending through said body and said end parts.

2. A developing roller according to claim 1, wherein each of said tapered joints comprise a beveled portion and a shoulder portion.

3. A developing roller according to claim 2, wherein each of said end parts has a cone shaped bore to mate with said beveled portion of said joint and a flat surface area to mate with said shoulder portion of said tapered joint.

4. A developing roller according to claim 1, wherein said toner is single component non-magnetic toner comprising particles with a diameter of 3–15 $\mu$m.

5. A developing roller according to claim 1, wherein said body and said end parts are made of different materials and are firmly joined at said tapered joints.

6. A developing roller according to claim 5, wherein said end parts of the developing roller are made of conductive SEP (Silicon Ethylene Propylene) rubber having an ASKER A hardness of over 45°, and said toner is negatively charged in order to form a toner image on said photosensitive drum.

7. A developing roller according to claim 5, wherein said end parts of the developing roller are made of conductive NBR (Nitril Butadiene Rubber) having an ASKER A hardness of over 45°, and said toner is negatively charged in order to form a toner image on said photosensitive drum.

8. A developing roller according to claim 5, wherein said end parts of the developing roller have an ASKER A hardness of over 45°, and said toner is negatively charged in order to form a toner image on said photosensitive drum.

9. A developing roller according to claim 5, wherein said end parts of the developing roller are made of conductive polyurethane having an ASKER A hardness of over 45°, and said toner is negatively charged in order to form a toner image on said photosensitive drum.

10. A developing roller according to claim 5, wherein said end parts of the developing roller are made of conductive PTFE (polytetrafluoroethylene resin), and said toner is positively charged in order to form a toner image on said photosensitive drum.

11. A developing roller for receiving toner from a supply roller and applying said toner to a photosensitive drum in an image forming apparatus, said developing roller comprising:

a body having tapered ends and a cylindrical portion between said tapered ends, said tapered ends corresponding to a non-image region of said photosensitive drum and said cylindrical portion corresponding to an image region of said photosensitive drum;

cylindrical end parts each having a surface portion for tightly mating with all surface areas of said tapered ends corresponding to said non-image region of said photosensitive drum;

a developing roller shaft for transferring a driving force and maintaining strength of the developing roller;

circular seals each mounted on a supply roller shaft at opposite sides of said supply roller, for preventing said toner from leaking out to the non-image region; and side-wall seals each mounted on said supply roller shaft at respective side walls of said circular seals and on said developing roller shaft at respective side walls of said cylindrical end parts, for preventing said toner from leaking out to an exterior portion of said image forming apparatus.

12. A developing roller according to claim 11, wherein said tapered ends form corresponding joints for joining the body of said developing roller to said cylindrical end parts, wherein each of said joints have a beveled portion and a shoulder portion.

13. A developing roller according to claim 1, wherein said toner is single component non-magnetic toner having particle with a diameter of 3–1550 $\mu$m.

14. A developing roller according to claim 11, wherein said body and said cylindrical end parts are made of different materials and are inseparably joined.

15. A developing roller according to claim 14, wherein said cylindrical end parts of the developing roller are made of conductive SEP (Silicon Ethylene Propylene) rubber or conductive NBR (Nitril Butadiene Rubber).

16. A developing roller according to claim 14, wherein said cylindrical end parts have a high friction tolerance.

17. A developing roller according to claim 15, wherein said cylindrical end parts have an ASKER A hardness of over 45°, and said toner is negatively charged in order to form a toner image on said photosensitive drum.

18. A developing unit for applying toner to a photosensitive drum in an image forming apparatus, said developing unit comprising:

a developing roller body having a cylindrical surface area corresponding to an image forming region of said photosensitive drum;

developing roller end parts having a cylindrical surface area corresponding to a non-image forming region of said photosensitive drum, wherein said cylindrical surface area of said developing roller body and said cylindrical surface area of said developing roller end parts are made of different materials;

joints formed at opposite side walls of said developing roller body for enabling a corresponding side wall of each of said developing roller end parts to mate with said developing roller body to form a developing roller;

a developing roller shaft for transferring a diving force and maintaining strength of the developing roller;

circular seals mounted on a toner supply roller shaft at opposite sides of a toner supply roller, for preventing the toner from leaking out to the non-image forming region; and rectangular side-wall seals mounted at side walls of said circular seals and at side walls of said developing roller, for preventing the toner from leaking out to an exterior, said rectangular side-wall seals being mounted on said developing roller shaft and said toner supply roller shaft.

19. A developing roller according to claim 18, wherein said developing roller end parts are made of conductive PTFE (polytetrafluoroethylene resin) having a high tolerance for abrasion.

20. A developing roller according to claim 18, wherein said developing roller end parts are made of conductive SEP (Silicon Ethylene Propylene) rubber or conductive NBR (Nitril Butadiene Rubber), having a high tolerance for abrasion.

21. A developing roller according to claim 18, wherein said developing roller end parts are made of conductive polyurethane having a high tolerance for abrasion.

22. A developing roller according to claim 18, wherein each of said joints comprise a beveled portion and a shoulder portion, each said shoulder portion forming a respective one of said opposite side walls of said developing roller body, and each of said developing roller end parts having a cone shaped bore forming a conical surface area for mating with said beveled portion of respective ones of said joints.

23. A method for manufacturing a developing roller for applying toner to a photosensitive drum in an image forming apparatus, said method comprising the steps of:

forming from a first material, by a molding or extruding process, cylindrical end parts having a cone shaped bore;

inserting each of said cylindrical end parts into respective collars of a molding press;

mounting a developing roller shaft between said collars;

inserting said collars, said cylindrical end parts and said developing roller shaft into a lower hard core of said molding press;

attaching an upper hard core to said lower hard core;

introducing a second material different from said first material into open areas between said upper and lower hard cores to form a roller body having a cylindrical central portion corresponding to an image forming central region of a photosensitive drum, said cylindrical end parts corresponding to non-image forming end regions of said photosensitive drum; and applying heat and pressure to said molding press to form said developing roller.

24. The method as set forth in claim 23, further comprising steps of:

removing said developing roller from said molding press: and subjecting said developing roller to a series of curing, cutting, and polishing processes in order to refine said developing roller.

25. The method as set forth in claim 23, wherein said first material is a material having an ASKER A hardness over 45° once said cylindrical end parts are formed.

* * * * *